US011409219B2

(12) United States Patent
Hosoda et al.

(10) Patent No.: US 11,409,219 B2
(45) Date of Patent: Aug. 9, 2022

(54) IMAGE FORMING APPARATUS AND IMAGE FORMING SYSTEM

(71) Applicant: FUJIFILM BUSINESS INNOVATION CORP., Tokyo (JP)

(72) Inventors: Kazuma Hosoda, Kanagawa (JP); Kana Omura, Kanagawa (JP); Hideo Kimura, Kanagawa (JP); Kyoko Matsushita, Kanagawa (JP); Takumi Nishikata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 175 days.

(21) Appl. No.: 16/570,032

(22) Filed: Sep. 13, 2019

(65) Prior Publication Data

US 2020/0096927 A1 Mar. 26, 2020

(30) Foreign Application Priority Data

Sep. 25, 2018 (JP) ..... JP2018-178623

(51) Int. Cl.
*G03G 15/00* (2006.01)

(52) U.S. Cl.
CPC ..... *G03G 15/5062* (2013.01); *G03G 15/5083* (2013.01); *G03G 15/6508* (2013.01); *G03G 15/6591* (2013.01)

(58) Field of Classification Search
CPC ..... G03G 15/5083; G03G 15/6058; G03G 15/6588; G03G 15/6591;
(Continued)

(56) References Cited

U.S. PATENT DOCUMENTS 5,551,686 A * 9/1996 Sanchez ..... B65H 39/11 270/58.18
5,848,346 A * 12/1998 Takashiro ..... G03G 15/6538 399/404
(Continued)

FOREIGN PATENT DOCUMENTS

JP H11-119940 A 4/1999
JP 2005-59983 A 3/2005
(Continued)

OTHER PUBLICATIONS

Jun. 14, 2022 Office Action issued in Japanese Patent Application No. 2018-178623.

*Primary Examiner* — Carla J Therrien
(74) *Attorney, Agent, or Firm* — Oliff PLC

(57) ABSTRACT

An image forming apparatus includes an image forming unit, an acquisition unit, and a controller. The image forming unit forms images of an output material set including multiple types of output materials. The acquisition unit acquires image information of the output material set transmitted from a terminal apparatus. The terminal apparatus provides an identifier for identifying the output material set to each of the multiple types of output materials included in the output material set and transmits image information of each of the multiple types of output materials. The controller controls, in a case where the image information of the multiple types of output materials for each output material set is ready, the image forming unit to form the images of the output material set.

10 Claims, 8 Drawing Sheets

(58) Field of Classification Search
CPC ..... G03G 2215/00126; G03G 2215/00447; G03G 2215/00556; G03G 2215/00603; G03G 2215/0089; G03G 2215/00902
See application file for complete search history.

(56) References Cited

U.S. PATENT DOCUMENTS 6,304,849 B1 * 10/2001 Uecker ..... G16H 20/10 705/3
7,307,744 B2 12/2007 Hikawa
2003/0076525 A1 * 4/2003 Hikawa ..... H04N 1/2376 358/1.14
2004/0042803 A1 * 3/2004 Fujikura ..... G03G 15/6502 399/23
2005/0025543 A1 * 2/2005 Watanabe ..... G03G 15/6558 399/391
2007/0164096 A1 * 7/2007 Banfield ..... G16H 20/13 235/375
2008/0075490 A1 * 3/2008 Ota ..... G03G 15/6594 399/45
2008/0094645 A1 * 4/2008 Sato ..... G06K 15/00 358/1.1
2011/0301978 A1 * 12/2011 Shiu ..... G16H 10/60 705/3
2012/0075646 A1 * 3/2012 Koike ..... G06K 15/1809 358/1.9
2013/0098985 A1 * 4/2013 Chambers ..... B41F 17/00 235/375
2013/0308157 A1 * 11/2013 Palmer ..... G06Q 10/083 358/1.15

FOREIGN PATENT DOCUMENTS

JP 2006-94127 A 4/2006
JP 2006092165 A * 4/2006
JP 3906667 B2 4/2007
JP 2008-162043 A 7/2008
JP 2009-56614 A 3/2009
JP 2009-96149 A 5/2009
JP 2016-057351 A 4/2016

* cited by examiner

FIG. 8

| CATEGORY | PRINTED MATERIAL FOR WHICH RUNNING OUT OF PAPER HAS OCCURRED | PRINTING CONTENTS OF SPECIFYING PAPER | LED LIGHT-EMITTING MANNER |
|---|---|---|---|
| A | PRINTED MATERIAL TO BE GIVEN TO PATIENT<br><br>(EXAMPLE)<br>MEDICINE INFORMATION DOCUMENT<br>MEDICINE BAG<br>STICKERS FOR NOTEBOOK | (1) NOTHING IS PRINTED (WHITE PAPER).<br>(2) PATIENT IDENTIFIER IS PRINTED. | URGENT |
| B | PRINTED MATERIAL NOT TO BE GIVEN TO PATIENT BUT GREATLY AFFECTING DOSAGE SERVICE<br><br>(EXAMPLE)<br>MEDICATION HISTORY FILE | IMAGE OF ACTUAL JOB IS PRINTED. | NORMAL |
| C | PRINTED MATERIAL NOT TO BE GIVEN TO PATIENT AND LESS AFFECTING DOSAGE SERVICE<br><br>(EXAMPLE)<br>DISPENSING RECORD | (1) NOTHING IS PRINTED (WHITE PAPER).<br>(2) PATIENT IDENTIFIER IS PRINTED. | NORMAL |

IMAGE FORMING APPARATUS AND IMAGE FORMING SYSTEM

CROSS-REFERENCE TO RELATED APPLICATIONS

This application is based on and claims priority under 35 USC 119 from Japanese Patent Application No. 2018-178623 filed Sep. 25, 2018.

BACKGROUND

(i) Technical Field

The present disclosure relates to an image forming apparatus and an image forming system.

(ii) Related Art

In Japanese Unexamined Patent Application Publication No. 2016-057351, an image forming apparatus that includes a first paper feed cassette, a second paper feed cassette, a third paper feed cassette, and a fourth paper feed cassette each including a display and causes a processor of the image forming apparatus to select one of the paper feed cassettes, based on setting information included in a printing instruction issued from a user so that a light-emitting diode (LED) lamp configuring the display provided at the selected paper feed cassette is turned on, is disclosed. That is, in the image forming apparatus described in Japanese Unexamined Patent Application Publication No. 2016-057351, a problem that an operating cassette is drawn out and paper jam thus occurs because a paper feed condition is not able to be visually recognized is addressed, and to this end, an LED is used to notify that the cassette is being used.

In Japanese Unexamined Patent Application Publication No. 2009-096149, a paper output device that includes a paper output tray that outputs output paper on which an image is formed, detecting means for detecting whether or not output paper is loaded on the paper output tray, and notifying means for notifying the loading state of output paper detected by the detecting means is disclosed. That is, in the paper output device described in Japanese Unexamined Patent Application Publication No. 2009-096149, a problem that paper is wrongly taken out in the case where a plurality of sheets of output paper for a plurality of people are mixed up on the paper output tray, is addressed, and to this end, an LED is used to notify the tray from which paper has been fed.

SUMMARY

Aspects of non-limiting embodiments of the present disclosure relate to providing an image forming apparatus and an image forming system in which misidentification is reduced compared to the case where output is performed every time that each of jobs regarding a plurality of output materials is received.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image forming unit, an acquisition unit, and a controller. The image forming unit forms images of an output material set including multiple types of output materials. The acquisition unit acquires image information of the output material set transmitted from a terminal apparatus. The terminal apparatus provides an identifier for identifying the output material set to each of the multiple types of output materials included in the output material set and transmits image information of each of the multiple types of output materials. The controller controls, in a case where the image information of the multiple types of output materials for each output material set is ready, the image forming unit to form the images of the output material set.

BRIEF DESCRIPTION OF THE DRAWINGS

Exemplary embodiments of the present disclosure will be described in detail based on the following figures, wherein:

FIG. 8 is a diagram illustrating printing contents of specifying paper and a light-emitting manner of an LED for each category of a printed material for which running out of paper occurs in the second exemplary embodiment.

DETAILED DESCRIPTION

Hereinafter, exemplary embodiments of the present disclosure will be described in detail with reference to drawings. In the explanation provided below, an aspect in which an image forming apparatus and an image forming system according to an exemplary embodiment is applied to an image forming apparatus and an image forming system at a pharmacy will be described as an example. An image forming apparatus and an image forming system at a pharmacy form images of an output material set for each patient onto a plurality of predetermined types of recording media.

First Exemplary Embodiment

Figure 1A:
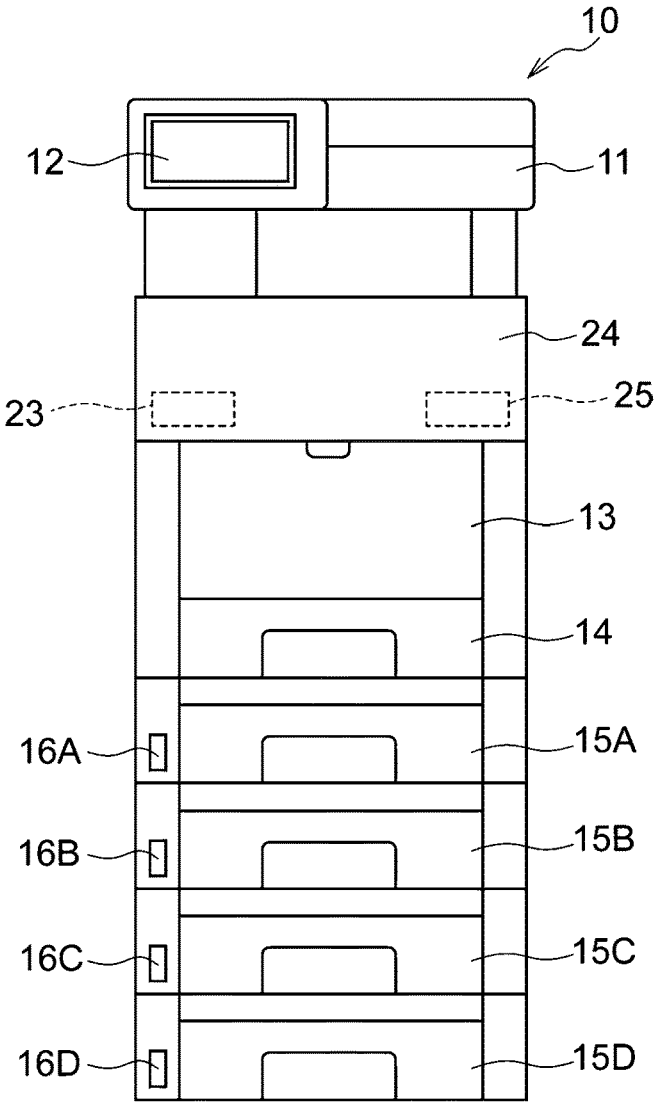
FIG. 1A is an external view illustrating an example of a configuration of an image forming apparatus according to an exemplary embodiment.

An image forming apparatus and an image forming system according to a first exemplary embodiment will be described with reference to FIGS. 1A and 1B and FIGS. 2 to 4. FIG. 1A is a diagram illustrating the external appearance of an image forming apparatus 10 according to the first exemplary embodiment. As illustrated in FIG. 1A, the image forming apparatus 10 includes an image reading unit 11, an image forming unit 24, a user interface (UI) unit 12, a manual feed tray 13, a paper feed tray 14, and paper feed trays 15A to 15D (hereinafter, may be generically referred to as "paper feed trays 15").

The image forming unit 24 is a unit that forms an image (hereinafter, may be referred to as "performs printing") on a recording medium (hereinafter, may be referred to as "paper"), based on image information (image data). Image data may be image data transmitted from a terminal apparatus, which will be described later, or image data of an image read by the image reading unit 11. Methods for forming images include an electrophotographic system, an inkjet system, and the like. In the first exemplary embodiment, a method for forming images is not particularly limited, and the image forming unit 24 may adopt any method. The image forming unit 24 according to the first exemplary embodiment includes, a controller 25 and a memory 23, which will be described later. The controller 25 includes a central processing unit (CPU), a read only memory (ROM), a random access memory (RAM), and the like, which are not illustrated in figures. Furthermore, the memory 23 is, for example, memory means such as a hard disk drive (HDD), a RAM, and the like.

The image reading unit 11 is a unit that optically reads an image formed on a medium such as paper and converts the image into image data. The image reading unit 11 includes an image sensor and is provided with a so-called scanner function.

The UI unit 12 is a unit that inputs, for example, an instruction for operating the image forming apparatus 10 and displays, for example, an operating state of the image forming apparatus 10. The configuration of the UI unit 12 is not particularly limited. The UI unit 12 may be, for example, a liquid crystal screen including a touch panel.

The manual feed tray 13 and the paper feed trays 14 and 15 are units that supply paper to the image forming unit 24. The manual feed tray 13 is a tray that supplies paper manually. The paper feed trays 14 and 15 are trays that supply paper automatically. In the image forming apparatus 10 and an image forming system 1 according to the first exemplary embodiment, various types of paper with different sizes, different colors, and the like are used. Various types of paper to be supplied may be set for the manual feed tray 13 and the paper feed trays 14 and 15.

Furthermore, the paper feed trays 15A, 15B, 15C, and 15D of the image forming apparatus 10 according to the first exemplary embodiment include light emitting diodes (LEDs) 16A, 16B, 16C, and 16D (hereinafter, may be generically referred to as "LEDs 16"), respectively. As described later, the LEDs 16 include a function for displaying an operating state of the paper feed trays 15, such as running out of paper. The "LEDs 16" are an example of "notification units" according to an exemplary embodiment of the present disclosure.

Figure 1B:
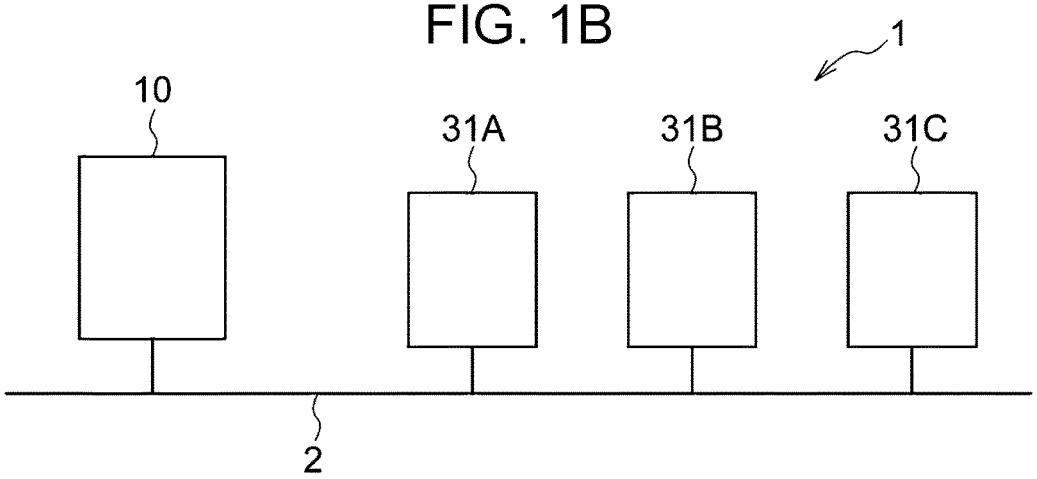
FIG. 1B is a block diagram illustrating an example of an image forming system according to an exemplary embodiment.

As illustrated in FIG. 1B, the image forming system 1 according to the first exemplary embodiment includes the image forming apparatus 10 and terminal apparatuses 31A, 31B, and 31C (hereinafter, may be generically referred to as "terminal apparatuses 31") that are connected to the image forming apparatus 10 via a network 2. The form of the terminal apparatuses 31 in the first exemplary embodiment is not particularly limited. For example, personal computers (PCs), tablet equipment, or the like may be used as the terminal apparatuses 31. Furthermore, the network 2 in the first exemplary embodiment may be a communication line such as a so-called local area network (LAN) for wired or wireless transmission.

Figure 2:
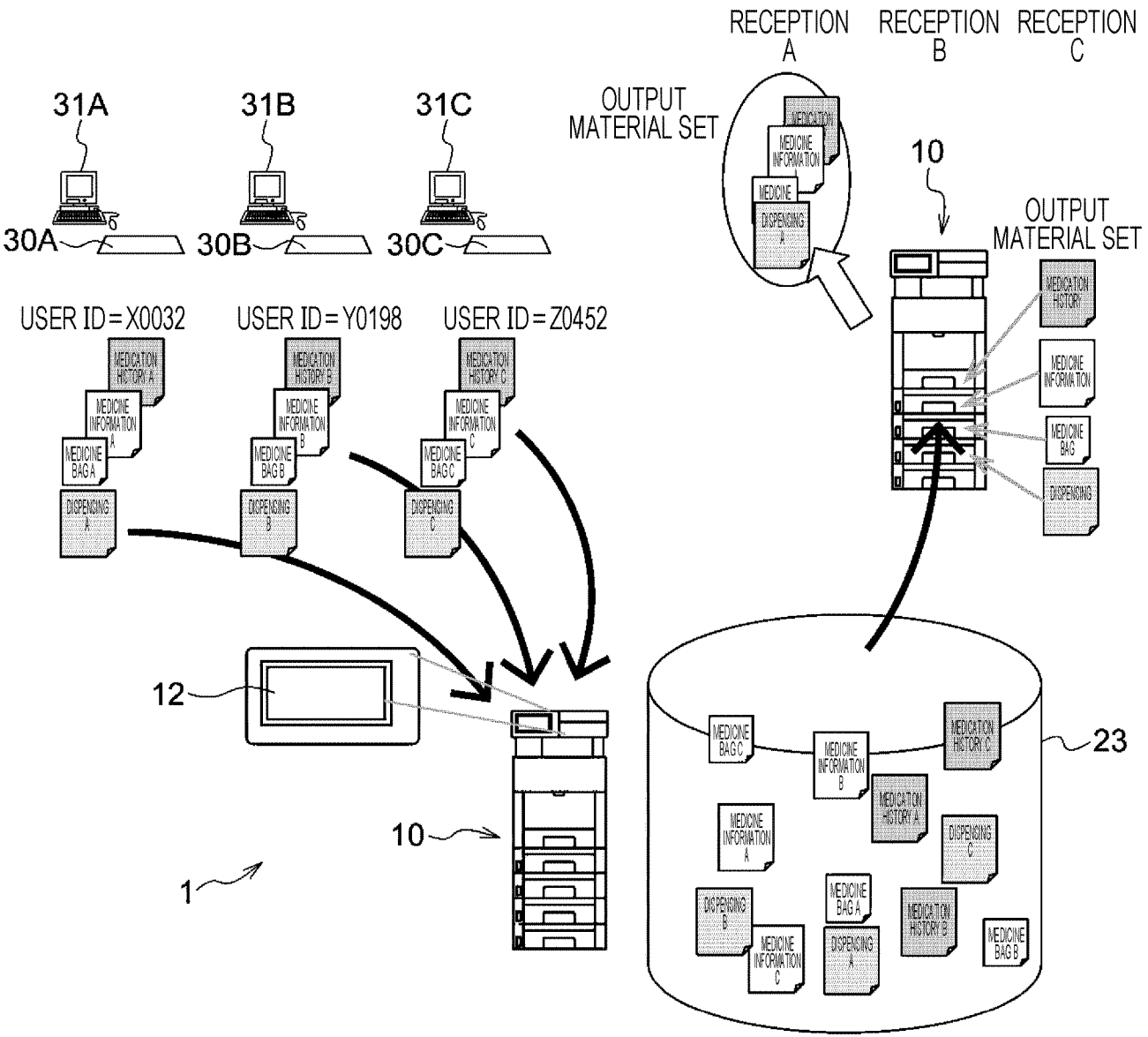
FIG. 2 is a diagram illustrating an example of a configuration of an image forming system according to a first exemplary embodiment.

The image forming system 1 according to the first exemplary embodiment will be described in more detail with reference to FIG. 2. FIG. 2 illustrates an example of a specific configuration of the image forming system 1. As described above, the image forming system 1 is a system that forms images of an output material set for each patient onto a plurality of predetermined types of recording media at a pharmacy.

First, an output material set in the first exemplary embodiment will be explained. At a pharmacy, a patient presents a prescription prescribed by a doctor, and a pharmacy staff member gives the patient a medicine bag containing a pharmaceutical product conforming to the prescription and a printed material associated with the pharmaceutical product. Previously, medicine bags were often made of paper. Recently, however, an object indicated on a plastic bag has been usually enclosed in the plastic bag. In the first exemplary embodiment, explanation will be provided based on the assumption of a plastic bag as a medicine bag. At a pharmacy, many other printed materials as well as medicine bags are printed for each patient. A "printed material" configuring an output material set in the first exemplary embodiment represents a printed material that is usually output to a paper output tray, as described below, and a "printed material" in the first exemplary embodiment includes white paper on which nothing is printed.

For example, printed materials associated with a medicine bag for each patient are categorized as below according to types of paper of printed materials:

(1) a medicine information document (A4 white paper) . . . written information of a pharmaceutical product;
(2) a medicine bag (B5 white paper and a plastic bag) . . . a bag containing an object describing the name of a patient and the like and a pharmaceutical product;
(3) stickers for a notebook . . . stickers to be placed on a "medicine notebook" for a patient;
(4) a medication history file (A4 color paper) . . . a document on which a medication dose history is written, and dispensing and a dosage instruction by a pharmacist are recorded; and
(5) a dispensing record (A4 color paper) . . . a dispensing record, with an obligatory storage period of three years.

In the first exemplary embodiment, a set of printed materials (1) to (5) mentioned above is called an "output material set". Only a medicine information document, a medicine bag, and stickers for a notebook in an output material set are given to a patient, and a medication history file and a dispensing record are stored at a pharmacy.

As mentioned above, various types (size and color) of paper are used for printed materials for patients. In the case where paper for a medication history file and paper for a dispensing record have different colors, four types of paper are required. Thus, the number of image forming apparatuses that are used to print these printed materials has been equal to the number of types of paper on which these printed materials are to be printed. For example, in the example mentioned above, four image forming apparatuses are required, and a receptionist at a pharmacy collects printed materials from the four image forming apparatuses, prepares a set of printed materials for each patient, and gives the set for the patient to a pharmacist.

Therefore, a huge amount of time and effort is required for the receptionist to collect printed materials from the image forming apparatuses and create an output material set for each patient. Furthermore, in the case where there are a plurality of receptions, it is difficult to determine for which reception printing of an output material set is completed. In the case where an output material set is printed by a single image forming apparatus that includes a plurality of paper feed trays, some effort may be reduced. Basically, however, a similar problem still exists.

For example, printed materials assumed in the first exemplary embodiment, which are represented by printed materials that a pharmacy gives each patient, together with a pharmaceutical product, have the following characteristics:

(1) an output material set includes a plurality of types of printed materials for each target person;

(2) paper is often different among printed materials; and (3) contents printed on printed materials are different among target people.

Thus, paper, that is, paper feed means corresponding to the types of printed materials need to be prepared.

For example, in the case where a plurality of printed materials are printed by a single image forming apparatus including a plurality of pieces of paper feed means, even if a single terminal apparatus is used, when different types of application software are used for printed materials, output printed materials for individual patients may be mixed up. In actuality, it is often the case that, in association with the number of receptions at a pharmacy, a plurality of terminal apparatuses make requests to print printed materials. In the case where a plurality of terminal apparatuses are used, even if each of the terminal apparatuses requires the printer to collectively output all the printed materials, the printed materials for individual patients may be mixed up depending on the processing at the image forming apparatus. If printed materials for individual users are mixed up, it is extremely troublesome to prepare an output material set for each patient, and misidentification is highly likely to occur.

Thus, in the present disclosure, in the case where image information (data) of a plurality of types of output materials for each output material set is ready, images of the output material set are formed. Consequently, an image forming apparatus in which misidentification is reduced compared to the case where output is performed every time that each of jobs regarding a plurality of output materials is received, may be provided.

Next, the image forming system 1 according to the first exemplary embodiment will be described in more detail with reference to FIG. 2. In the example of FIG. 2, the image forming system 1 includes receptions 30A, 30B, and 30C (hereinafter, may be generically referred to as "receptions 30") and the image forming apparatus 10 as an image forming apparatus. Furthermore, terminal apparatuses 31A, 31B, and 31C are provided at the receptions 30A, 30B, and 30C, respectively. Receptionists at the receptions 30A, 30B, and 30C are allocated to corresponding user IDs. That is, for example, the user ID of the receptionist at the reception 30A is "X0032", the user ID of the receptionist at the reception 30B is "Y0198", and the user ID of the receptionist at the reception 30C is "Z0452".

As illustrated in FIG. 2, when patients present prescriptions at the receptions 30, instructions for printing the four printed materials described above, that is, a medicine information document (represented as "medicine information" in FIG. 2), a medicine bag, a medication history file (represented as "medication history" in FIG. 2), and a dispensing record (represented as "dispensing" in FIG. 2), are transmitted from the corresponding terminal apparatuses 31 to the image forming apparatus 10. In the first exemplary embodiment, "stickers for a notebook" in the above-mentioned printed materials is omitted. That is, an output material set in the first exemplary embodiment includes a medicine information document, a medicine bag, a medication history file, and a dispensing record.

Furthermore, in the first exemplary embodiment, different types of application software are used to generate image data of printed materials, and a printing instruction for a single printed material configures a single job. That is, printing requests for printed materials included in an output material set for each patient received at a corresponding reception 30 are separately transmitted to the image forming apparatus 10 in units of printed materials. At this time, application software sets the document name of each printed material as "document name"+"patient ID". A "document name" represents any one of a medicine information document, a medicine bag, a medication history file, and a dispensing record, and a "patient ID" represents a code (identifier) for identifying a patient. That is, in the first exemplary embodiment, an output material set is identified by a patient ID as an "identifier". A printer driver of application software adds the document name to a print command and transmits the print command including the document name to the image forming apparatus 10. A job for each printed material transmitted to the image forming apparatus 10 is stored into the memory 23 of the image forming apparatus 10, as illustrated in FIG. 2.

In contrast, in the image forming apparatus 10, the following details are registered as registered items to determine whether or not image data of an output material set for each patient is ready:

(1) the number of printed materials;

(2) a document name wildcard; and (3) a patient identifier wildcard.

The number of printed materials is equal to the number of types of printed materials configuring an output material set. In the first exemplary embodiment, the number of printed materials is four. A document name wildcard represents a wildcard for identifying a document and is expressed in the format of "medication history file *" or the like. Furthermore, a patient identifier wildcard represents a wildcard accompanying a code for identifying a patient. More specifically, a patient identifier wildcard is expressed in the format of "patient *" or the like. By registering a document name wildcard and a patient identifier wildcard with the image forming apparatus 10, a target printed material is identified, and the printed material is identified as a printed material associated with the identified patient. The registration of the registered items (1) to (3) mentioned above is performed by, for example, inputting the registered items (1) to (3) using the UI unit 12, and registered information is stored into, for example, the memory 23.

A printing instruction for each printed material in the format of a document name of "document name"+"patient ID", as described above, more specifically, such as "medication history file, Hanako Yamada", is transmitted from each terminal apparatus 31 to the image forming apparatus 10. Then, the controller 25 appropriately refers to the memory 23, and determines whether or not jobs for document names corresponding to the number of printed materials for each patient identifier are ready. In accordance with a result of the determination, in the case where it is determined that printing instructions for printed materials configuring an output material set are ready, printing of the output material set for the corresponding patient, that is, printing of all the printed materials, is collectedly performed.

Figure 3:
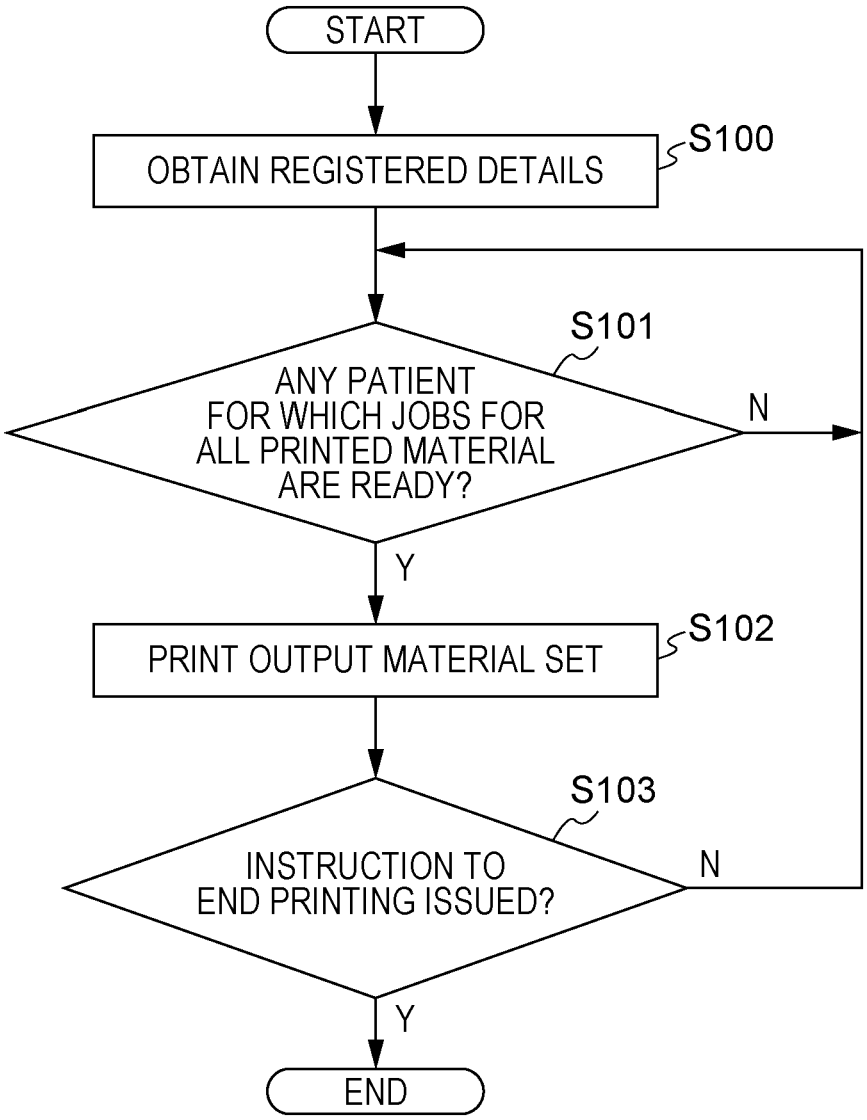
FIG. 3 is a flowchart illustrating the flow of a process of an image forming processing program according to the first exemplary embodiment.
Figure 4:
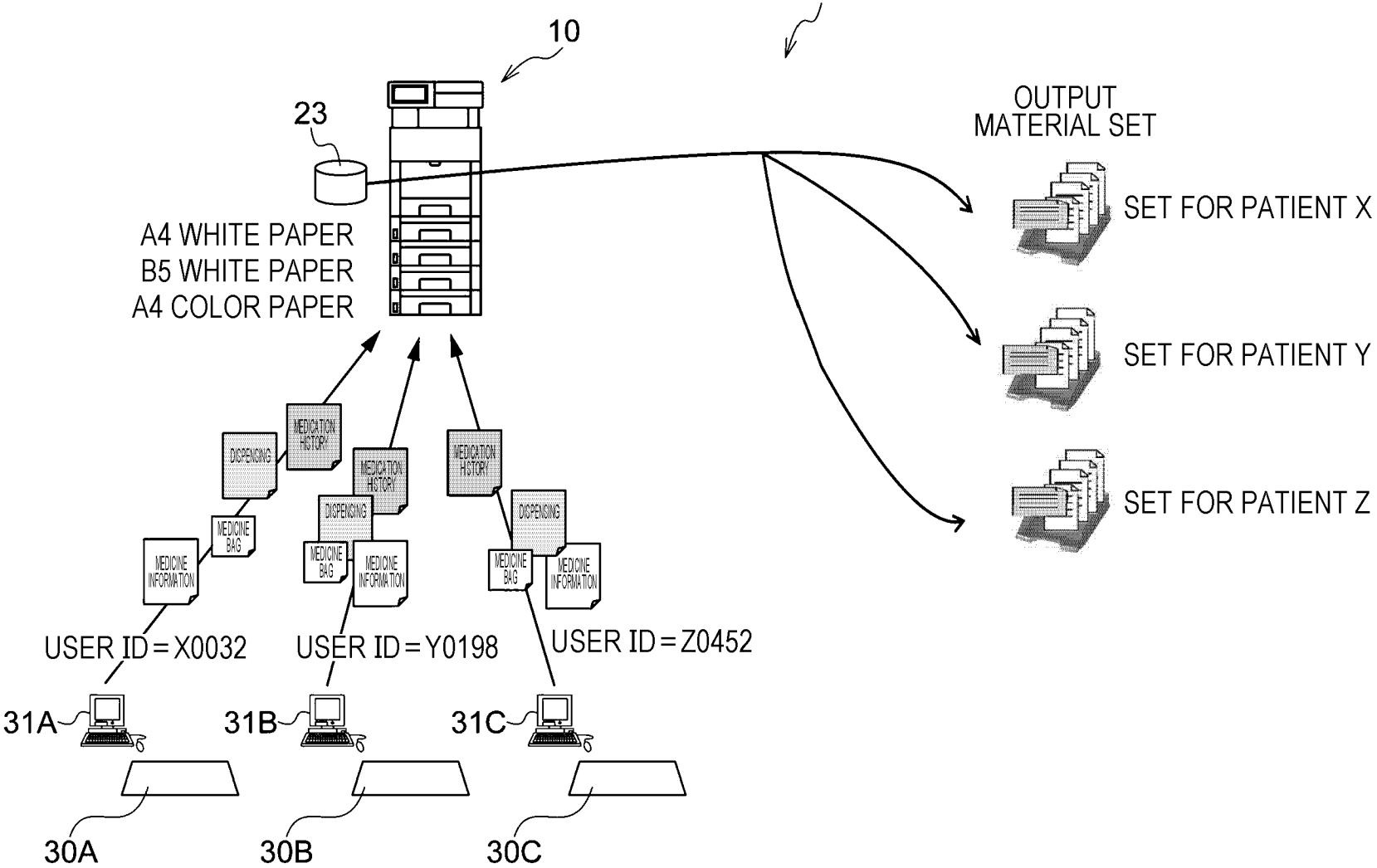
FIG. 4 is a diagram illustrating an operation of the image forming system according to the first exemplary embodiment.

Next, an image forming process performed by the image forming apparatus 10 according to the first exemplary embodiment will be described with reference to FIGS. 3 and 4. FIG. 3 is a flowchart illustrating the flow of a process of an image forming processing program executed in the image forming process. The image forming processing program is stored in memory means such as a ROM, which is not illustrated in figures, of the image forming apparatus 10. When the image forming apparatus 10 receives an instruction to start execution of the image forming processing program via the UI unit 12 or the like, a CPU, which is not illustrated in figures, reads the image forming processing program from the memory means such as the ROM, loads the image forming processing program onto a RAM or the like, and executes the image forming processing program. Furthermore, in the first exemplary embodiment, as illustrated in FIG. 4, each type of paper used for printed materials ("A4 white paper", "B5 white paper", "A4 color paper", and so on illustrated in FIG. 4) is able to be fed from any one of the paper feed trays 15, as illustrated in FIG. 4.

As illustrated in FIG. 3, in step S100, the image forming apparatus 10 acquires registered details from the memory 23 or the like. "Registered details" represent the registered items (1) to (3) mentioned above.

In step S101, based on the registered details acquired by referring to the memory 23 in step S100, the process waits until jobs for all the printed materials for a patient become ready. In the case where there is a patient for which jobs for all the printed materials are ready, the process proceeds to step S102. In the case where it is determined in step S101 that there are a plurality of patients for which jobs for all the printed materials are ready, the order for performing printing for the plurality of patients may be set.

In step S102, the image forming apparatus 10 prints an output material set for the patient for which it is determined in step S101 that jobs for all the printed materials are ready. At this time, it is desirable that the order for discharging printed materials configuring the output material set is set in advance. In the case where it is determined in step S101 that there are a plurality of patients for which jobs for all the printed materials are ready, printing is performed in the order of patients set in step S101.

In step S103, it is determined whether or not an instruction to end printing is issued. In the case where a negative determination result is obtained in step S103, the process returns to step S101 and waits until jobs for all the printed materials for a patient become ready. In the case where an affirmative determination result is obtained in step S103, the image forming processing program ends. The determination as to whether or not an instruction to end printing is issued may be performed, for example, by determining whether or not ending of the image forming processing program is received via the UI unit 12. In FIG. 4, a state in which output material sets for patients X, Y, and Z are sequentially prepared and printed in this order. In this case, the output material sets for the patients X, Y, and Z are discharged in this order to a paper output tray, which is not illustrated in figures, of the image forming apparatus 10 in a state in which all the printed materials are present. As a result, a receptionist at each reception 30 is able to reduce time and effort to collect an output material set for each patient.

A use form of the LEDs 16 in the first exemplary embodiment will be explained. As described above, jobs are transmitted in units of patients and in units of printed materials at random from terminal apparatuses 31 at the receptions 30 to the image forming apparatus 10. In this case, a receptionist at each reception 30 is not able to determine whether or not printed materials for a patient transmitted by the receptionist are prepared as an output material set and printing is performed. Thus, in the first exemplary embodiment, the state of a job for each reception 30 is indicated using a corresponding LED 16. That is, in the first exemplary embodiment, any one of the plurality of LEDs 16 is allocated to each reception 30. For example, in the first exemplary embodiment, the LED 16A is allocated to the reception 30A (terminal apparatus 31A), the LED 16B is allocated to the reception 30B (terminal apparatus 31B), and the LED 16C is allocated to the reception 30C (terminal apparatus 31C). The state of a job is identified according to a light-emitting manner of the corresponding LED 16. Each LED may be controlled by the controller 25. Furthermore, association between each terminal apparatus 31 and a corresponding LED 16 may be performed using a user ID of a receptionist at a corresponding reception 30.

More specifically, in the case where the image forming apparatus 10 receives a job for the first printed material for a patient at a reception 30, a corresponding LED 16 is caused to flash. For example, in the case where a job for a medication history file for the patient Y is received from the reception 30B, the LED 16B is caused to flash, and flashing continues until printing of an output material set including the medication history file is completed. Accordingly, the receptionist at the reception 30B is notified that jobs for printed materials for the patient Y of which the receptionist is in charge are being processed. Next, when jobs for all the four printed materials regarding the patient Y are ready and printing of the corresponding output material set is performed, the state of the LED 16B is changed from the flashing state to a solid ON state. Accordingly, the receptionist at the reception 30B is notified that printing of the output material set for the patient Y of which the receptionist is in charge is completed.

That is, in the image forming system 1 according to the first exemplary embodiment, a receptionist moves to the image forming apparatus 10 at the time when printing of an output material set for a patient of which the receptionist is in charge is completed, and the time and effort for moving to the image forming apparatus 10 for confirmation every time that each print job is transmitted may thus be eliminated. Furthermore, as described above, by the time when the receptionist arrives at the image forming apparatus 10, the output material set for the patient of which the receptionist is in charge has been collectively arranged at a paper output tray, which is not illustrated in figures. Therefore, a collection operation may be performed quickly. In the case where the LEDs 16 are used as described above, a terminal apparatus 31 from which a job for each printed material is transmitted needs to be identified. Therefore, an identifier of the terminal apparatus 31 (or a user ID of the receptionist) or the like may be added to a document name ("document name"+"patient ID").

The LEDs 16 are originally used to notify that corresponding paper feed trays 15 are out of paper. That is, different light-emitting manners of the LEDs 16 need to be allocated to three modes: "printing in progress"; "printing completed"; and "out of paper". Thus, in the first exemplary embodiment, a flashing operation at higher speed (shorter period) than that for "printing in progress" is allocated to "out of paper". That is, the light-emitting manners of the LEDs 16 for the modes "printing in progress", "printing completed", and "out of paper", and "standby" are as described below:

"standby" . . . OFF;

"printing in progress" . . . flashing at low speed;

"printing completed" . . . solid ON; and

"out of paper" . . . flashing at high speed.

For example, the state in which the LED 16B is flashing at low speed represents that the image forming apparatus 10 has started to receive print jobs for the patient Y transmitted from the reception 30B (terminal apparatus 31B), the state in which the LED 16B is solid ON represents that printing of an output material set for the patient Y is completed, and the state in which the LED 16B is flashing at high speed represents that the paper feed tray 15B is out of paper.

In the case where modes and the light-emitting manners of the LEDs 16 are set as described above, a condition for transition from solid ON to OFF is:

(1) a predetermined time has passed since solid ON;

(2) an OFF button for an LED 16 is pressed via the UI unit 12; or (3) paper is eliminated from a paper output tray, which is not illustrated in figures.

In the first exemplary embodiment, for example, the condition (1) is adopted as a condition for transition from solid ON to OFF.

The above-mentioned allocation of the light-emitting manners of the LEDs 16 to modes is merely an example, and allocation may be performed in a different way. Furthermore, an aspect in which the light-emitting color of the LEDs 16 is one color has been explained above as an example. However, an LED that emits light in a plurality of colors may be used as the LED 16. In this case, for example, by allocating a light-emitting color of an LED 16 to each reception 30, the above-mentioned mode may be identified by a single LED.

As describe above, with the configuration in which modes are indicated using the LEDs 16, the effects described below may be obtained. That is, with the use of an LED provided as a standard configuration of the image forming apparatus 10, low cost may be achieved. Furthermore, only by visually recognizing the LEDs 16 provided at the corresponding paper feed trays 15, modes regarding a printing state (printing in progress or printing completed) and an out-of-paper mode may be confirmed. Furthermore, draw-out faces of the paper feed trays 15 are less likely to be blocked by an object or the like. Therefore, the LEDs 16 for display are usually easily seen. Furthermore, the UI unit 12 is not used to display a mode, the present disclosure may also be applied to an inexpensive image forming apparatus not including a UI unit.

Second Exemplary Embodiment

An image forming apparatus and an image forming system according to a second exemplary embodiment will be explained with reference to FIGS. 5A and 5B and FIGS. 6 to 8. In the second exemplary embodiment, processing performed in the case where running out of paper occurs at any one of the paper feed trays 15 of the image forming apparatus 10 is added.

Figure 5B:
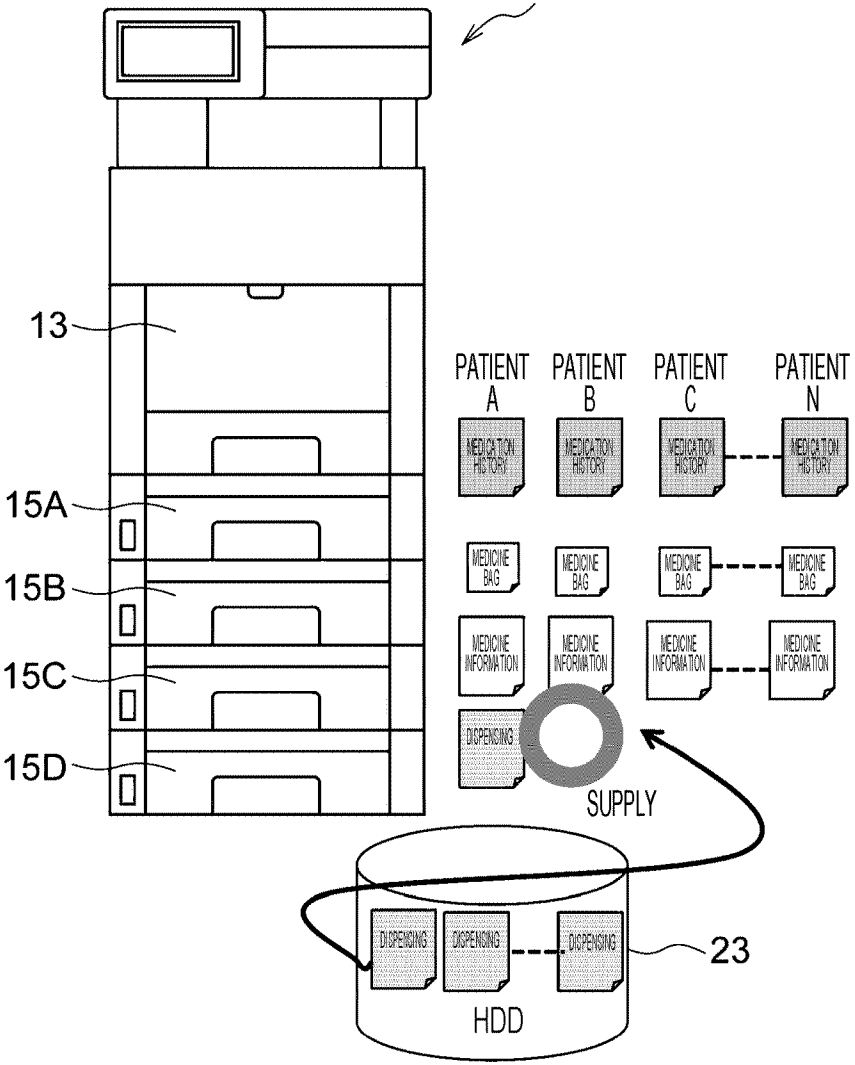
FIGS. 5A and 5B are diagrams illustrating an example of a configuration of an image forming system according to a second exemplary embodiment.
Figure 5A:
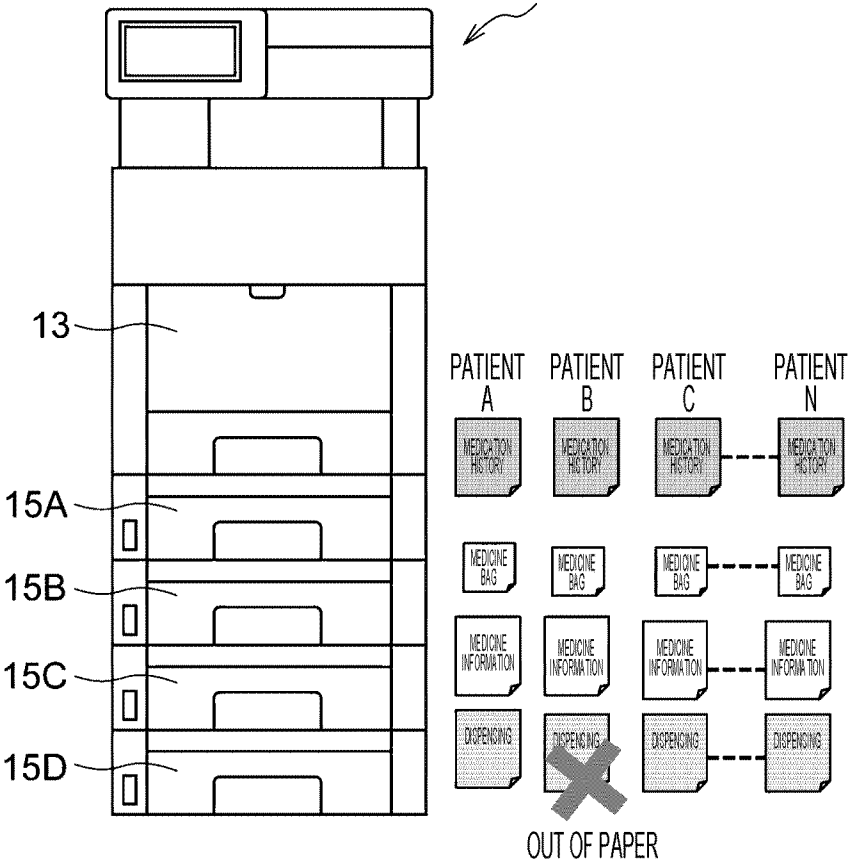

In the second exemplary embodiment, as illustrated in FIG. 5A, setting is performed such that a medication history file, a medicine bag, a medicine information document, and a dispensing record are output from the paper feed tray 15A, the paper feed tray 15B, the paper feed tray 15C, and the paper feed tray 15D, respectively. Basically, printing is performed collectively from the paper feed trays 15 at the time when jobs for printed materials corresponding to each of patients A, B, C, . . . , and N are ready. However, it is assumed that, for example, running out of paper has occurred at the paper feed tray 15D out of the paper feed trays 15, as illustrated in FIG. 5A.

At this time, the image forming apparatus 10 according to the second exemplary embodiment performs job-overtaking processing. That is, jobs for the paper feed tray 15D, which is out of paper, are stored in the memory 23, and jobs corresponding to the other paper feed trays 15A, 15B, and 15C are first printed, overtaking the jobs for the paper feed tray 15D. More specifically, even if the paper feed tray 15D is out of paper, as illustrated in FIG. 5A, the image forming apparatus 10 performs printing corresponding to the paper feed trays 15A, 15B, and 15C, without stopping a printing operation. Jobs for dispensing records during the period up to recovery of the paper feed tray 15D are accumulated in the memory 23.

Next, when paper is supplied to the paper feed tray 15D, as illustrated in FIG. 5B, printing of jobs for dispensing records accumulated in the memory 23 is started. Printing of all the dispensing records is performed collectively. The image forming apparatus 10 according to the second exemplary embodiment operates as described above even if running out of paper occurs at any one of the paper feed trays 15. Therefore, time loss caused by stoppage of an operation during the period from occurrence of running out of paper to supply of paper may be reduced. For example, it is assumed that the image forming apparatus 10 has a capability of printing output material sets for five people per minute. If it takes ten minutes to supply paper, fifty output material sets are able to be printed during this period. Thus, this period corresponds to time loss.

However, even the image forming apparatus 10 that operates as described above has points to be improved. That is, according to the operation described above, after running out of paper occurs at the paper feed tray 15D, printed materials from the paper feed trays 15A, 15B, and 15C are accumulated at a paper output tray, which is not illustrated in figures, in that order during the period up to supply of paper to the paper feed tray 15D. That is, a set of a medication history file, a medicine bag, and a medicine information document for each patient is accumulated at the paper output tray. Hereinafter, this uncompleted output material set will be referred to as an "uncompleted output material set". However, in this case, a point to be improved is that it is difficult to recognize that there is a lack of printed material for each patient. That is, what needs to be improved is that it is difficult to understand for which patient's output material set a dispensing record printed after paper is supplied to the paper feed tray 15D is to be inserted. If it requires ten minutes to supply paper under the condition mentioned above, fifty dispensing records collectively printed after paper is supplied need to be inserted into output material sets for fifty people, which is assumed to require a huge amount of time.

Figure 6:
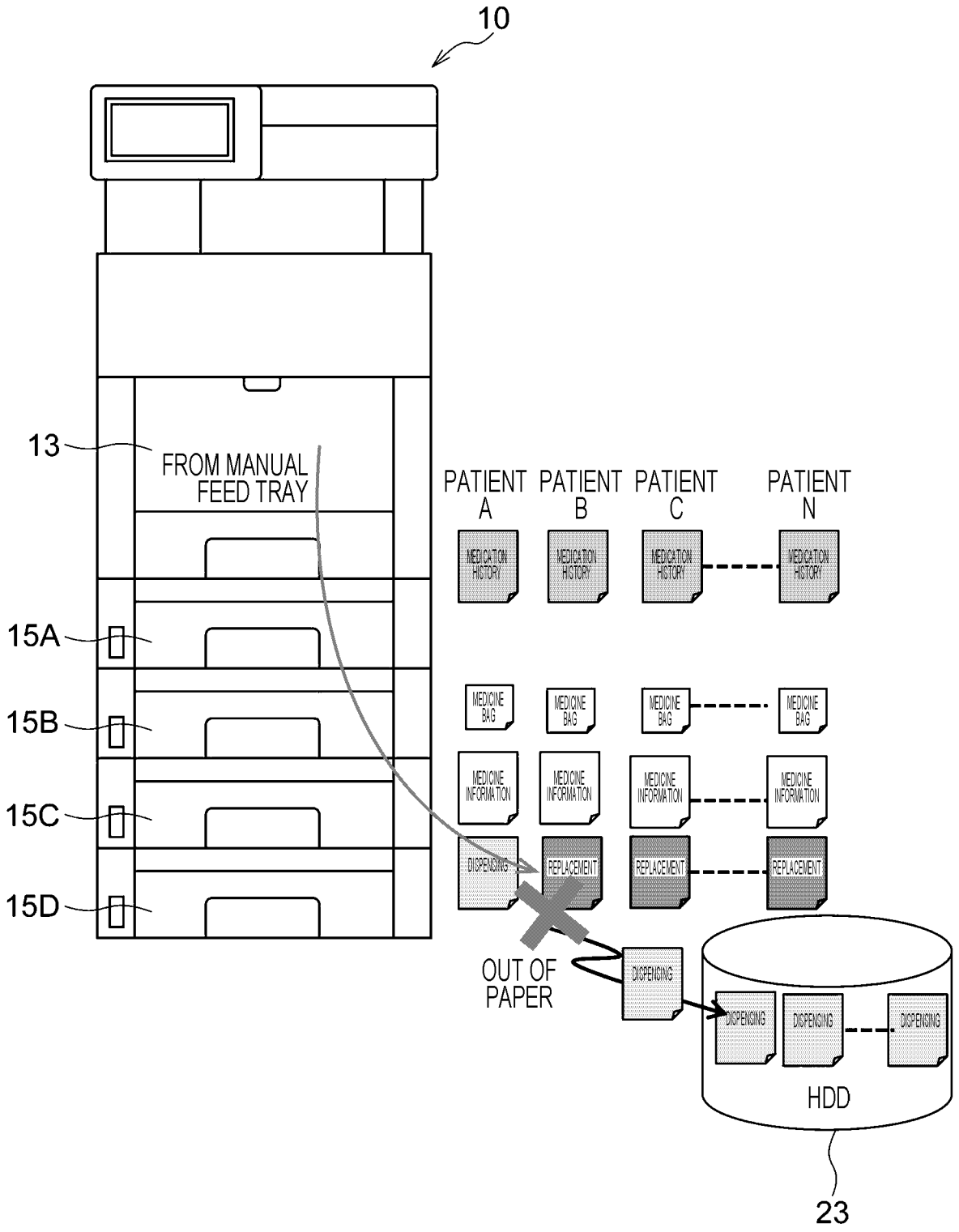
FIG. 6 is a diagram illustrating an operation of the image forming system according to the second exemplary embodiment.

Thus, in the second exemplary embodiment, paper for specifying a place for replacement of a missing printed material in the uncompleted output set (hereinafter, referred to as a "specifying paper") is used. That is, in the case where running out of paper has occurred at any one of the paper feed trays 15, jobs for printed materials corresponding to the paper feed tray that is out of paper are accumulated in the memory 23 and printing of the jobs are postponed. At the same time, specifying paper (represented as "replacement" in FIG. 6) is inserted in place of a printed material to be originally printed from the paper feed tray that is out of paper, as illustrated in FIG. 6. At this time, specifying paper may be paper that is visually noticeable, for example, paper with a size larger than other printed materials or paper with a color different from those of other printed materials. Accordingly, the fact that there is a lack of printed material in an output material set may be easily recognized. Specifying paper may be supplied from the manual feed tray 13. However, specifying paper is not necessarily supplied from the manual feed tray 13. Specifying paper may be supplied from a surplus paper feed tray (in the second exemplary embodiment, for example, the paper feed tray 14). An aspect in which specifying paper is supplied from a manual feed tray as illustrated in FIG. 6 will be explained below as an example. "Specifying paper" is an example of an "alternative output material" according to an exemplary embodiment of the present disclosure.

After that, in the case where paper is supplied to the paper feed tray 15D at which running out of paper occurred, the image forming apparatus 10 stops printing corresponding to the paper feed trays 15A, 15B, and 15C, and collectively prints dispensing records accumulated in the memory 23 during the period up to that time. Hereinafter, the collectively printed dispensing records may be referred to as "complementary printed materials". A receptionist replaces the specifying paper inserted into the uncompleted output material set with the collectively printed complementary printed materials.

Figure 7:
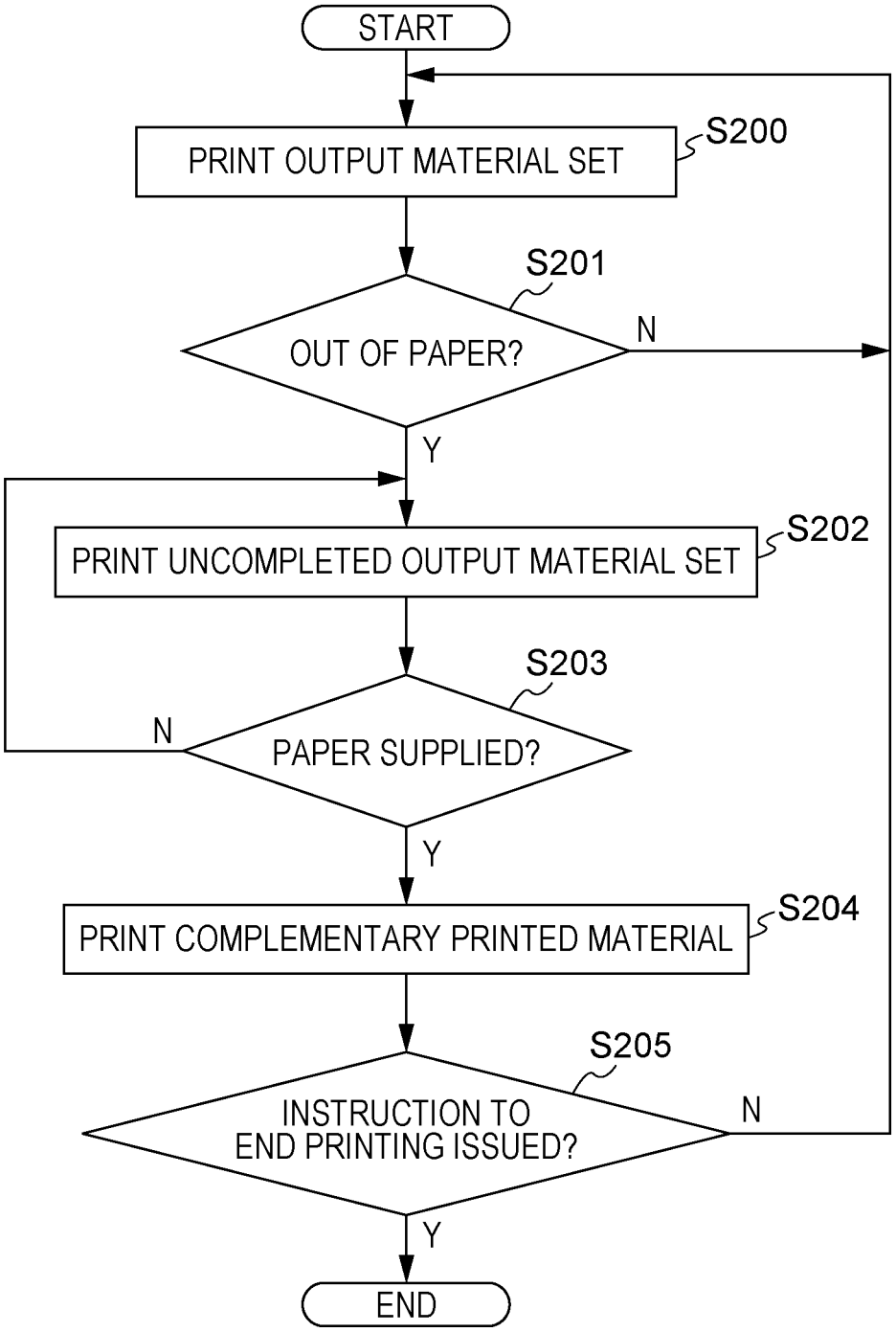
FIG. 7 is a flowchart illustrating the flow of a process of an image forming processing program according to the second exemplary embodiment.

Next, an image forming process performed by the image forming apparatus 10 according to the second exemplary embodiment will be described with reference to FIG. 7. FIG. 7 is a flowchart illustrating the flow of a process of an image forming processing program executed in the image forming process. The image forming processing program is stored in memory means such as a ROM, which is not illustrated in figures, of the image forming apparatus 10. When the image forming apparatus 10 receives an instruction to start execution of the image forming processing program via the UI unit 12 or the like, a CPU, which is not illustrated in figures, reads the image forming processing program from the memory means such as the ROM, loads the image forming processing program onto a RAM or the like, and executes the image forming processing program.

As illustrated in FIG. 7, in step S200, the image forming apparatus 10 prints a normal output material set. Processing of step S200 corresponds to processing of steps S100 to S102 in FIG. 3.

Next, in step S201, the image forming apparatus 10 determines whether or not running out of paper has occurred at any one of the paper feed trays 15. In the case where a negative determination result is obtained in step S201, it is determined that no paper feed tray 15 is out of paper, and the process returns to step S200 and continues to print an output material set. In contrast, in the case where running out of paper has occurred, the process proceeds to step S202.

Next, in step 202, the image forming apparatus 10 prints an uncompleted output material set, that is, a set of printed materials into which specifying paper is inserted in place of a dispensing record in an output material set, the dispensing record corresponding to the paper feed tray 15D, which is out of paper.

Next, in step S203, the image forming apparatus 10 determines whether or not supply of paper to the paper feed tray 15D, which is out of paper, has been performed. In the case where a negative determination result is obtained in step S203 and it is determined that paper is not supplied, the process returns to step S202 and continues to print an uncompleted output material set. In contrast, in the case where an affirmative determination result is obtained in step S203 and supply of paper is completed, the process proceeds to step S204.

In step S204, complementary printed materials, that is, dispensing records accumulated in the memory 23, are collectively printed. At this time, printing corresponding to the other paper feed trays 15 is stopped. A receptionist replaces the specifying paper in the uncompleted output material sets that has been output during the period up to this point in time with the dispensing records output in this step.

In step S205, the image forming apparatus 10 determines whether or not an instruction to end printing is issued. In the case where a negative determination result is obtained in step S205, the process returns to step S200 and continues to print an output material set. In contrast, in the case where an affirmative determination result is obtained in step S205, the image forming processing program ends. With the image forming processing program, the whole processing of the flowchart (steps S200 to S205) is not interrupted. Therefore, time loss caused by running out of paper may be reduced.

Printing contents of specifying paper and light-emitting manners of the LEDs 16 will be discussed with reference to FIG. 8. In the second exemplary embodiment, for example, printed materials for which running out of paper has occurred are categorized according to the purpose of use, and printing contents of specifying paper and light-emitting manners of the LEDs 16 are set in accordance with the categorization results.

As illustrated in FIG. 8, printed materials for which running out of paper has occurred are categorized into categories A, B, and C, as illustrated in FIG. 8. Printed materials to be given to patients, such as a medicine information document and a medicine bag, belong to the category A. In the second exemplary embodiment, an aspect in which stickers for a notebook are omitted has been explained as an example. However, in the case where stickers for a notebook are printed, the stickers for a notebook also belong to the category A. Printed materials that are not given to patients but greatly affect a dosage service, such as a medication history file, belong to the category B. A medication history file corresponds to a medical record. A medication history file needs to be acquired quickly. Otherwise, a dosage service may be stopped. Printed materials that are not given to patients and less affect a dosage service, such as a dispensing record, belong to the category C. A dispensing record only needs to be attached to a prescription just for storage.

Taking into account categories of printed materials for which running out of paper has occurred as described above, states of printing contents may be considered as follows:

(1) a state in which nothing is printed (white paper), and this state is suitable for a case where it is only needed to indicate that replacement is required;

(2) a state in which a patient identifier is printed, a position in which a patient identifier is printed is, for example, an upper end or a lower end of specifying paper, and this state is suitable for the case where mistake in replacement is to be prevented; and (3) a state in which an image of an actual job is printed with the same size, reduced size, or increased size, and this state is suitable for the case where a dosage service is desired to be performed using temporary paper before replacement is completed.

Examples of printing contents of specifying paper and light-emitting manners of LEDs for the categories A, B, and C are illustrated in FIG. 8.

That is, (1) "nothing is printed" or (2) "a patient identifier is printed" is performed for specifying paper in the category A. As described above, a position in paper where a patient identifier is printed is, for example, an upper end or a lower end of the paper. In the case where printing for a plurality of patients is performed at the same time, it is preferable that patient identifiers be printed. In contrast, the light-emitting manner of an LED corresponds to an "urgent" mode. This is because printed materials that are required to be given to patients on the spot belong to the category A. A specific example of the light-emitting manner corresponding to the "urgent" mode will be described later.

Images of actual jobs are printed on specifying paper in the category B. At this time, the images may be images with the same size as the actual images or may be reduced or enlarged images, as described above. It is only needed to make the contents readable by a receptionist. In contrast, the light-emitting manner of an LED corresponds to a "normal" mode. This is because printed materials that are not required to be given to patients belong to the category B and do not affect execution of a service by a receptionist as long as an actual image may be read in some format. A specific example of the light-emitting manner corresponding to the "normal" mode will be described later.

As in the category A, (1) "nothing is printed" or (2) "a patient identifier is printed" is performed for specifying paper in the category C. As described above, a position in paper where a patient identifier is printed is, for example, an upper end or a lower end of the paper. In the case where printing for a plurality of patients is performed at the same time, it is preferable that patient identifiers be printed. In contrast, the light-emitting manner of an LED corresponds to a "normal" mode. This is because printed materials not required to be given to patients belong to the category C.

Now, specific examples of the light-emitting manners for the "urgent mode" and the "normal" mode of the LEDs 16 will be explained. As described above, the light-emitting manners of the LEDs 16 for a normal printing mode in which running out of paper does not occur are set as follows:

"standby" . . . OFF;

"printing in progress" . . . flashing at low speed;

"printing completed" . . . solid ON; and

"out of paper" . . . flashing at high speed.

In order to add further light-emitting manners such as the "urgent" mode and the "normal" mode to an LED 16, for example, the light-emitting color of the LED 16 may be considered. For example, a light-emitting color of "green" is allocated to the normal printing mode mentioned above, and a light-emitting color of "red" is allocated to the "urgent" mode. For example, the light-emitting manners of the LEDs 16 are defined as described below.

<Normal printing mode: light-emitting color=green>

"Standby" . . . OFF

"Printing in progress" . . . Green light flashing at low speed

"Printing completed" . . . ON solid green

"Out of paper (normal)" . . . Green light flashing at high speed

"Out of paper (urgent)" . . . Red light flashing at high speed

An aspect in which the "normal" light-emitting manner of an LED corresponding to the category B is not distinguished from the "normal" light-emitting manner of an LED corresponding to the category C has been explained as an example in the second exemplary embodiment. However, these two "normal" states may be distinguished from each other.

An aspect in which the present disclosure is applied to an image forming system has been explained as an example in the foregoing exemplary embodiment. However, the present disclosure is not limited to this. The present disclosure may be applied to general printed materials having the following characteristics conforming to printed materials to be given to individual patients along with pharmaceutical products at a pharmacy as described above:

(1) an output material set for each person includes a plurality of types of printed materials;

(2) printed materials are printed on different types of paper; and (3) contents printed on printed materials are different depending on the individual.

Printed materials having the above-mentioned characteristics include, for example, invitations for various types of events or the like, documents addressed to residents created by government offices, report cards for students from tutoring schools, and the like. The present disclosure may also be applied to the-above mentioned printed materials.

Furthermore, in each of the foregoing exemplary embodiments, an aspect in which the present disclosure is applied to a single image forming apparatus including a plurality of paper feed trays has been explained as an example. However, the present disclosure is not limited to this. For example, the present disclosure may be applied to an aspect in which each of a plurality of image forming apparatuses prints a corresponding one of a plurality of printed materials configuring an output material set or an aspect in which part of the plurality of image forming apparatuses prints a plurality of printed materials. In the case where a plurality of image forming apparatuses are used, a server or the like that controls all the plurality of image forming apparatuses may be separately provided. Alternatively, one of the plurality of image forming apparatuses may be defined as a master apparatus, whereas the other image forming apparatuses may be defined as slave apparatuses.

Furthermore, in each of the foregoing exemplary embodiments, an aspect in which the LEDs 16 provided at the paper feed trays 15 notify that an output material set is being printed, printing is completed, or the like has been explained as an example. However, the present disclosure is not limited to this. For example, notification may be provided to the terminal apparatuses 31 at the receptions 30. In this case, notification indicating that image data for an output material set is ready may be provided to the terminal apparatuses 31 at the receptions 30 before printing is performed. In this aspect, a receptionist may cause printing of the preceding output material set to wait until print jobs of the next output material set are transmitted to the image forming apparatus 10 and then collect all the plurality of output material sets later. Accordingly, patients at the receptions 30 may be dealt with more flexibly.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming unit that forms images of an output material set including a plurality of types of output materials;

a processor programmed to function as an acquisition unit that acquires image information of the output material set transmitted from a terminal apparatus, wherein the terminal apparatus provides an identifier for identifying the output material set to each of the plurality of types of output materials included in the output material set and transmits image information of each of the plurality of types of output materials, the processor further programmed to determine whether all jobs for all of the plurality of types of output materials for a single user are in a status ready for printing;

a controller that controls, in a case where all the jobs for all of the plurality of types of output materials for the single user are in the status ready for printing, the image forming unit to form the images of the output material set, and, in a case where one of the plurality of types of output materials for the single user is not in the status ready for printing due to a lack of available printing material, the controller controls the image forming unit to form the images of the output material set except for the one of the plurality of types of output material; and a plurality of supply units that supply recording media to the image forming unit, a plurality of types of recording media being stored in the plurality of supply units, wherein the controller controls the image forming unit to form an image of each of the plurality of types of output materials on a corresponding one of the plurality of types of recording media, wherein in a case where one of the plurality of supply units becomes unable to perform supply, the controller controls the image forming unit to output, as an alternative output material, a recording medium supplied from a different supply unit different from the supply unit that is not able to perform supply, out of the plurality of supply units, and wherein the controller controls the image forming unit to form no image on the alternative output material.

2. The image forming apparatus according to claim 1, wherein the acquisition unit acquires image information of output material sets from a plurality of terminal apparatuses.

3. The image forming apparatus according to claim 2, further comprising:

a plurality of LEDs that are associated with the plurality of terminal apparatuses, wherein in a case where output of an output material set is completed, the controller causes one of the plurality of LEDs that is associated with a corresponding one of the plurality of terminal apparatuses that has transmitted image information of the output material set for which output is completed to provide notification in a first manner.

4. The image forming apparatus according to claim 3, wherein in a case where image information of an output material set is received, the controller causes one of the plurality of LEDs that is associated with a corresponding one of the plurality of terminal apparatuses that has transmitted the received image information of the output material set to provide notification in a second manner that is different from the first manner.

5. The image forming apparatus according to claim 1, wherein the controller controls the acquisition unit to cause image information of an output material corresponding to the supply unit that is not able to perform supply to be stored in a memory, and wherein in a case where the supply unit that is not able to perform supply is recovered to be able to perform supply, the controller controls the image forming unit to form an image of the output material corresponding to the supply unit that is recovered to be able to perform supply.

6. The image forming apparatus according to claim 1, wherein a recording medium stored in the different supply unit is different from all the plurality of types of recording media stored in the plurality of supply units, except for the recording medium stored in the different supply unit.

7. The image forming apparatus according to claim 1, wherein in a case where formation of images of an output material set is started, the controller causes formation of images of a different output material set not to be started until formation of images of all the plurality of types of output materials included in the output material set is completed.

8. The image forming apparatus according to claim 1, wherein the controller controls the image forming unit to output the plurality of types of output materials included in the output material set in a predetermined order.

9. An image forming system comprising:

the image forming apparatus according to claim 1; and at least one terminal apparatus that is connected to the image forming apparatus via a communication line, the at least one terminal apparatus provides an identifier for identifying an output material set to each of a plurality of types of output materials included in the output material set and transmits image information of each of the plurality of types of output materials.

10. An image forming apparatus comprising:

image forming means for forming images of an output material set including a plurality of types of output materials;

acquisition means for acquiring image information of the output material set transmitted from a terminal apparatus that provides an identifier for identifying the output material set to each of the plurality of types of output materials included in the output material set and transmits image information of each of the plurality of types of output materials, the acquisition means further programmed to determine whether all jobs for all of the plurality of types of output materials for a single user are in a status ready for printing;

control means for controlling, in a case where all the jobs for all of the plurality of types of output materials for the single user are in the status ready for printing, the image forming unit to form the images of the output material set, and, in a case where one of the plurality of types of output materials for the single user is not in the status ready for printing due to a lack of available printing material, the control means controls the image forming unit to form the images of the output material set except for the one of the plurality of types of output material; and a plurality of supply means that supply recording media to the image forming means, a plurality of types of recording media being stored in the plurality of supply means, wherein the control means controls the image forming means to form an image of each of the plurality of types of output materials on a corresponding one of the plurality of types of recording media, wherein in a case where one of the plurality of supply means becomes unable to perform supply, the control means controls the image forming means to output, as an alternative output material, a recording medium supplied from a different supply means different from the supply means that is not able to perform supply, out of the plurality of supply means, and wherein the control means controls the image forming means to form no image on the alternative output material.

* * * * *